US012583074B2

(12) United States Patent
Koerbe et al.

(10) Patent No.: US 12,583,074 B2
(45) Date of Patent: Mar. 24, 2026

(54) TRANSPORTATION CARRIER FOR AUTOMATED LENS MANUFACTURING PROCESS AND RELATED MANUFACTURING FACILITY

(71) Applicant: SATISLOH AG, Baar (CH)

(72) Inventors: Thomas Koerbe, Baar (CH); Alexandre Cormier, Baar (CH); Jan Lotz, Baar (CH); Herger Alt, Baar (CH)

(73) Assignee: SATISLOH AG, Baar (CH)

( * ) Notice: Subject to any disclaimer, the term of this patent is extended or adjusted under 35 U.S.C. 154(b) by 447 days.

(21) Appl. No.: 18/004,378

(22) PCT Filed: Jul. 1, 2021

(86) PCT No.: PCT/EP2021/068251

§ 371 (c)(1),
(2) Date: Jan. 5, 2023

(87) PCT Pub. No.: WO2022/008351

PCT Pub. Date: Jan. 13, 2022

(65) Prior Publication Data

US 2023/0278156 A1 Sep. 7, 2023

(30) Foreign Application Priority Data

Jul. 7, 2020 (EP) ..... 20184570

(51) Int. Cl.
*B24B 13/00* (2006.01)
*B24B 13/06* (2006.01)
(Continued)

(52) U.S. Cl.
CPC ..... *B24B 13/0031* (2013.01); *B24B 13/06* (2013.01); *B24B 41/02* (2013.01); *B24B 51/00* (2013.01)

(58) Field of Classification Search
CPC . B24B 13/0031; B24B 13/0037; B24B 13/06; B24B 41/02; B24B 51/00;
(Continued)

(56) References Cited

U.S. PATENT DOCUMENTS

2009/0102613 A1 4/2009 Fontanot
2009/0105866 A1 4/2009 Fontanot
(Continued)

FOREIGN PATENT DOCUMENTS

EP 3 479 956 A1 5/2019

OTHER PUBLICATIONS

International Search Report Issued Oct. 27, 2021, in PCT/EP2021/068251 filed on Jul. 1, 2021, 3 pages.
(Continued)

*Primary Examiner* — Yunju Kim
(74) *Attorney, Agent, or Firm* — Oblon, McClelland, Maier & Neustadt, L.L.P.

(57) ABSTRACT

A transportation carrier is provided for automated lens manufacturing in a lens manufacturing facility, including: at least one block piece or one block piece receiving section; and an electronic paper display configured to display at least an up-to-date status information of the manufacturing process of the optical elements carried by the transportation carrier that is intelligible for a human operator without use of a reading device, the electronic paper display including a wireless communication module and a memory configured to exchange and to memorize job information and to process information for lenses to be manufactured, in which the electronic paper display is further configured to function as a passive RFID tag with the wireless communication module.

11 Claims, 3 Drawing Sheets

(51) Int. Cl.
*B24B 41/02* (2006.01)
*B24B 51/00* (2006.01)

(58) Field of Classification Search
CPC .... G05B 19/12; G05B 19/16; G05B 19/4183; G05B 2219/31322; G05B 2219/36371; Y02P 90/02
See application file for complete search history.

(56) References Cited

U.S. PATENT DOCUMENTS

| | | | | |
|---|---|---|---|---|
| 2019/0136367 | A1 | 5/2019 | Peter et al. | |
| 2019/0137791 | A1 | 5/2019 | Kreis | |
| 2019/0243345 | A1 | 8/2019 | Schwarz et al. | |
| 2019/0286112 | A1* | 9/2019 | Morris ..... | G05B 19/41865 |

OTHER PUBLICATIONS

Combined Chinese Office Action and Search Report issued on Jul. 11, 2025, in Chinese Patent Application No. 202180052474.9, with English translation, 20 pages.

* cited by examiner

TRANSPORTATION CARRIER FOR AUTOMATED LENS MANUFACTURING PROCESS AND RELATED MANUFACTURING FACILITY

FIELD OF THE INVENTION

The invention relates to a transportation carrier, like for example a transportation box, for automated lens manufacturing process and a related manufacturing facility.

BACKGROUND AND PRIOR ART

If in the following, by way of example, reference is made to "optical elements", in particular "spectacle lenses" for workpieces with optically effective surfaces there is to be understood by that not only optical elements of mineral glass, but also optical elements of all other customary materials such as polycarbonate, CR 39, HI index, etc., thus also plastics material.

The working or processing stations in production shops or manufacturing facilities for producing individual spectacle lenses from customary materials for example polycarbonate, mineral glass, and CR 39, HI-index, in accordance with a prescription order—also called "job"—are usually automated to a high degree. In that regard, serving within the production as transport means are transportation boxes—also termed prescription boxes or "job trays"—which are transported between the individual stations by way of, for example, transport belts, transverse roller devices for transverse exclusion from the material flow, lifting devices, switches, etc. Such transportation boxes are the subject of, for example, German Standard DIN 58763.

As described in, for example, document U.S. Publication No. 2004/0235397 in each instance the right hand and left hand spectacle lenses of a prescription order and optionally the associated precision-grinding tool or polishing tool for the respective spectacle lens can be received in the transportation boxes. In addition, a transportation box of that kind has a compartment for the often written in-house order, generally in paper form. This usually carries a marking in the form of a barcode or the like. On many occasions the transportation boxes themselves are also equipped with so-called "transponders" or "Radio Frequency Identification Devices", (RFID for short), i.e. semiconductor elements for storage and transmission of data with the help of which an identification of the respective prescription order and the instantaneous state of processing of the spectacle lenses is possible.

Spectacle lenses of various materials have to be supplied by the transportation boxes to different work stations or machines at which the spectacle lenses are processed by different additives and work materials (for example, polishing media, polishing pads) as well as different process parameters. A major part of this processing of the spectacle lenses takes place on so-called "block pieces" which serve the purpose of holding the spectacle lens blanks during processing in the respective processing machine or processing device. Such block pieces are the subject of, for example, German Standard DIN 58766.

According to this Standard, for so-called "blocking" of a spectacle lens blank on such a block piece, the block piece is initially brought into a predetermined position relative to a surface, which is usually protected by use of a film, of the spectacle lens blank. Then, in this position the space between block piece and spectacle lens blank is filled with a molten material, conventionally usually a Wood's metal, also termed "alloy", i.e. a metallic alloy usually based on bismuth. After hardening of the filler material, the block piece represents a mount for processing the spectacle lens blank.

In order to avoid the use of heavy metals connected with the afore-described alloy technology, to make handling safer for users and to reduce the loading of the environment in the production of spectacle lenses a technology for alloy-free blocking was developed by the applicant, called "ART" (standing for Alloy Replacement Technology) for short. This ART technology is described in detail in the brochure "Introduction to Alloy-free lens production", Frank Heepen, Product Management Blocking & Deblocking, V5.1LC of 15 Aug. 2015 published by Satisloh GmbH.

In summary, ART technology employs a universal, reusable organic block piece and ultraviolet-hardenable adhesive as blocking material for connection of a block piece and a spectacle lens blank instead of alloy and film so as to fix and protect the spectacle lens blanks in every case for so-called "generating", i.e. the preliminary processing of the optically effective surface of the spectacle lens blank for creating the macrogeometry in accordance with prescription, and polishing, thus precision-processing of the optically effective surface to eliminate preliminary-processing tracks and to obtain the desired microgeometry, as well as optionally also subsequent steps for example marking and coating. These block pieces in general have a substantially rotationally symmetrical base body which has on one side a lens fastening surface on which the lens blank can be blocked by use of the blocking material and on the other side a standardized chucking section by way of which the lens blank blocked on the base body can be fixed in a machine or device for processing or treating the lens blank.

As a rule, different groups of block pieces differing with respect to block curvature—also called "basic curve"—and diameter of lens fastening surface are used in an ART lens production shop. By that, primarily the object is pursued of approximating the geometry of the lens fastening surface of the block piece as much as possible to the respective geometry of the surface of the lens blank to be blocked. On the one hand the lens blank shall, by selection of a suitable diameter of the lens fastening surface at the block piece, undergo support over as much as possible of the whole area for the processing and be protected over as much as possible of the whole area at its surface which faces the block piece and which as a rule is processed to finished state and optionally also already coated. On the other hand, through selection of a suitable block curvature it is to be ensured that the blocking material between lens blank and block piece does not have substantial differences in thickness which due to shrinkage phenomena in the blocking material can lead to stresses in the blocked lens blank and ultimately to errors in geometry at the spectacle lens deblocked from the block piece, as described in detail in, for example, document U.S. Pat. No. 8,382,932.

Consequently, the result is a certain number of different block piece groups which, depending on how the ART lens production shop is operated, can amount to approximately 20 to 40. In production shops with reuse of block pieces, the block pieces not in immediate use have to be stored in the interim or kept in reserve. The block pieces are typically stored—sorted according to block piece groups—as bulk material in a corresponding number of storage boxes. The individual block pieces are in that case denoted by a Data Matrix Code (DMC for short), which allows individual tracking and management by use of a computer system.

If a prescription order is on hand, then a process control predetermines the block piece or members appropriate thereto, normally two block pieces, a respective one for each of the left hand and right hand spectacle lenses of the prescription order, but in a given case also only one if only one spectacle lens is to be made. The association of the block pieces, which are predetermined by the process control, with the respective prescription order is usually undertaken as a manual process: an operator removes the appropriate block piece or members from the corresponding storage box or boxes. In order to reduce confusion and mistakes this can be assisted by a so-called "pick-by-light" system in which a light controlled by the process control illuminates the appropriate storage box. The operator then places the appropriate block piece or members in the transportation box to be read. In that case, linking with the respective prescription order is carried out by way of the process control through scanning the DMC of the block pieces.

After completing the transportation boxes with the lens blanks appropriate to the respective prescription order the workpieces and block pieces run through the production process with the principal steps of:

(i) blocking the lens blanks on the block pieces, (ii) treating, i.e. processing and in a given case coating, the blocked lens blanks and (iii) deblocking the treated spectacle lenses from the block pieces, in which case transport between these steps takes place by use of the transportation boxes which in each instance remain associated with the respective prescription order.

After the deblocking procedure the used block pieces are conventionally brought back in the storage boxes from the production line as bulk material for cleaning, checking and sorting.

In order to reduce the manual effort connected therewith a fully automated deblocking system is available from the Applicant under the trade designation ART-Deblocker-A, which loads processed spectacle lenses in the deblocked state from transportation boxes, then separates these from the block piece and finally places the deblocked spectacle lenses back in the transportation boxes. In that case, the deblocking system separates block piece, blocking material and spectacle lens by water jet and thereafter also dries the front and rear sides of the respective spectacle lens for preparation in view of inspection. For reuse of the block pieces as efficiently as possible this deblocking system is ultimately also in a position of sorting the block pieces according to diameter and curvature and filing them in the appropriate storage boxes.

Finally, mention is also made in the aforesaid ART brochure of a block sorting system which is separate from the actual deblocking system and which is in a position of sorting used block pieces, which are returning from the production line, according to diameter and curvature and in that case also taking into consideration on the basis of the DMC of the respective block piece how often a block piece has already been used, as a criterion for whether the respective block piece is to be reused again or, however, separated out.

The prior art described to that extent does indeed fulfil the functional requirements for production of individual spectacle lenses according to prescription. However, the discussed manual working steps occasion a certain degree of outlay, which is connected with additional costs. Moreover, there is the risk of incorrect block pieces being assigned to specific prescription orders. Not least, the afore-described automatic approaches require a large deposit area and a relatively high investment per stored block piece.

In order to overcome these drawbacks, the applicant has developed a nearly fully automated system as outset in US20190137791.

One of the key elements of this nearly fully automated manufacturing system is the transportation box equipped with an RFID tag containing job information about the process to be undergone by the lens blanks contained in the transportation box.

The box wall is still provided with a slot, which basically serves the purpose of receiving a paper prescription order as information carrier. In addition, an information carrier in the form of an RFID, which can be both machine readable and writable to be recognized by the computer process control system, is received in the slot.

However, the manufacturing system may face unforeseeable or problematic events that need specific action or intervention of a human operator or supervisor.

Such unforeseeable or problematic events may concern for example a process step that for whatever reason could not be carried out with the necessary precision and/or quality (for example a tool which could not be replaced in time and is worn out).

In order to solve these problems, actions, particularly manual actions, connected with the separation of block piece and transportation box or (re-) allocation of block piece to transportation box and the outlay connected therewith may be necessary.

In this case, the relevant transportation box may be sorted out from the processing line of the manufacturing facility and stocked in a waiting location.

Then, for further treatment, an operator needs to get relevant information about actions to be taken or diagnosis concerning the out sorted transportation box in using a specific reader for example of the RFID tag or a bar-code reader, which is in many cases quite cumbersome as the operator also needs free hands for handling the boxes.

Furthermore, as in general, there are several transportation trays in one waiting location, the reading process may take a long time and the operator may be tempted to read the information of several transportation boxes once after another and then to direct the transportation boxes to different process stations from his memory which may be source of error for later action to be taken.

Another problem that may arise is an accidental shutdown of the whole manufacturing system, for example due to an electric problem. This may arise for example if the public grid for supply of electricity is shut down and the auxiliary power unit, for whatever reason, is unable to take the backup.

In this, however rare case, it might be very difficult to terminate already started jobs and lens manufacturing processes would need to be restarted from scratch. All lenses that have been started in the manufacturing process would need to be sorted out which is quite expensive.

Therefore one object of the present invention is to facilitate, in exceptional circumstances, manual action of a human operator, when needed.

To this extent, the present invention proposes a transportation carrier for automated lens manufacturing in a lens manufacturing facility comprising at least one block piece or one block piece receiving section wherein the transportation carrier further comprises an electronic paper display configured to display at least an up to date status information of the manufacturing process of the optical elements carried by the transportation carrier which is intelligible for a human operator without use of a reading device, the electronic paper display further comprises a wireless communication module and a memory for exchanging and memorizing job information and process information with regard to lenses to be manufactured and the electronic paper display is configured to function as a passive RFID tag with its wireless communication module.

Thanks to the electronic paper display, a human operator may be informed rapidly, without the use of a reader about the up-to-date status of the manufacturing process of the optical elements carried by the transportation carrier. He may also get direct intelligible instructions what to do. Thus he can solve problems faster, without risk of confusion between different transportation carriers.

The transportation carrier may present one or several of the following aspects taken alone or in combination.

The transportation carrier may further comprise a separate RFID tag, where the electronic paper display and the separate RFID tag are configured to share a memory.

The up to date status information comprises for example a short message or a symbol.

The electronic paper display may also be configured to display at least one optical machine readable identification information, in particular a barcode or a QR-code.

Furthermore, the electronic paper display is for example configured to receive and display processing data concerning the lenses to be manufactured.

It may be interesting that the electronic paper display is removable fixed to the transportation carrier, in particular by clipping elements.

In case the transportation carrier is realized as transportation box according DIN 58763, the electronic paper display may be fixed to a side wall of the transportation box having a location foreseen to receive a paper barcode.

The present invention also relates to a manufacturing facility for manufacturing of optical elements comprising:

- several workstations and processing stations,
- a transfer system for conveyance of transportation carriers for optical elements to be processed according to specific job data,
- transportation carriers as described here above,
- a process control system communicating with the workstations and processing stations and controlling the transfer system for conveyance of transportation carriers for optical elements to be processed according to specific job data, wherein the process control system is further configured to communicate with the electronic paper display of the transportation carrier for displaying at least an up-to-date status information of the manufacturing process of the optical elements carried by the transportation carrier which is intelligible for a human operator without use of a reading device.

BRIEF DESCRIPTIONS OF THE DRAWINGS

Other advantages and characteristics will appear with the reading of the description of the following figures.

DETAILED DESCRIPTION OF AN EMBODIMENT

The embodiment(s) in the following description are only to be considered as examples. Although the description may refer to one or several embodiments, this does not mean inevitably that every reference concerns the same embodiment, or that the characteristics apply only to a single embodiment. Simple characteristics of various embodiments can be also combined to new embodiments that are not explicitly described.

In the present description, the terms "upstream" and "downstream" are used according the following meaning: a first station for a certain processing operation of an optical element is placed upstream with respect to a second station when the optical element undergoes first the operation in the first station and then another operation in the second station.

And a first station for processing a certain processing operation of an optical element is placed downstream with respect to a second station when the optical element undergoes first the operation in the second station and then another operation in the first station.

By "surfacing", it is understood in particular polishing, grinding, fine grinding or finishing and the overall object is to yield a finished spectacle lens so that the curvature of a first (in this instance convex) face and the curvature of a machined second (in this instance concave) face cooperate to yield desired optical properties according to a prescription of the user of the spectacle lenses.

An optical element refers for example to an ophthalmic optical product, a lens blank or a semi-finished lens blank. The optical element may present or not an optical correction and may be used for as spectacle lens, in particular as sunglasses or masks.

The optical element may be formed of one layer or several layers attached to each other and forming a unitary element.

Figure 1:
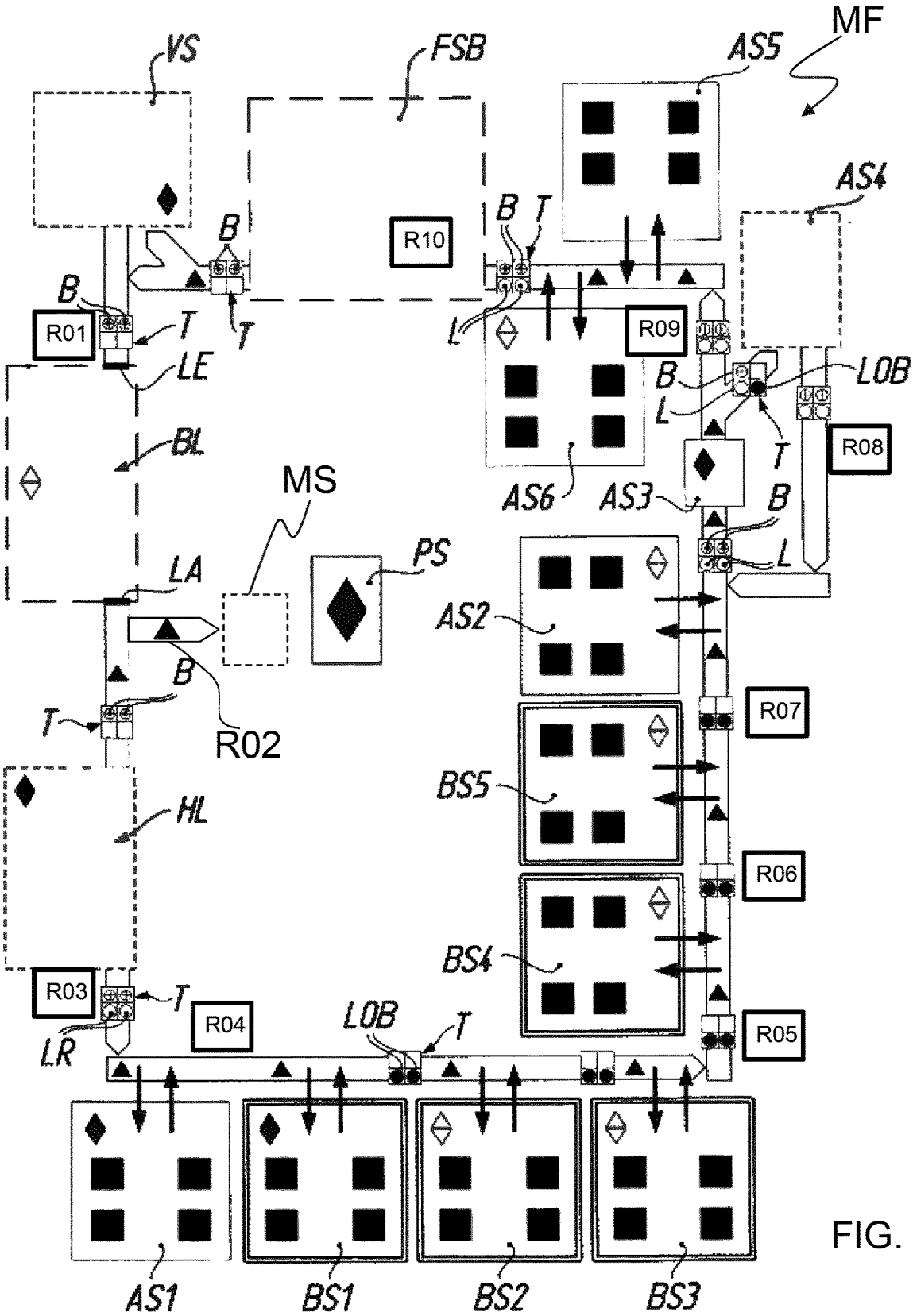
FIG. 1 shows a layout of a manufacturing facility for producing individual spectacle lenses according to prescription order, wherein a block piece storage for block pieces used during the production as well as a finishing region for the spectacle lenses and spectacles are illustrated merely as empty blocks.

FIG. 1 shows a layout of a manufacturing facility MF for manufacturing of individual optical elements like spectacle lenses L according to a prescription order, in which, as described in more detail in the following, the beneath detailed steps are in general run through in the indicated sequence for the production:

(i) blocking a provided lens blank LR with a block piece which is provided from a plurality a block pieces B from a block piece store BL, (ii) processing the blocked lens blank LR in order to obtain a blocked, processed spectacle lens L and (iii) deblocking the processed spectacle lens L from the block piece B.

The respective workpieces and block pieces for a prescription order are transported between the aforesaid steps (i) to (iii) on one of a plurality of provided transportation carriers which are realized in the present embodiment as transportation boxes T. In the case of the embodiment described here, there are in addition two features as explained in more detail in the following, namely on the one hand that the block pieces B are stored, prior to the step (i) of blocking, in the transportation boxes T in the block piece store BL and are provided in the transportation boxes T from the block piece store BL for the step (i) of blocking and on the other hand that the block pieces B after the step (iii) of deblocking are transported in the transportation boxes T back to the block piece store BL.

In another not represented embodiment, the transportation carrier can be realized in another way, in particular not as a box. For example, one may consider to realize the block piece B, in particular with a more important diameter, and the conveyors can be arranged in a way that the block piece B itself may act as a transportation carrier.

The production layout of FIG. 1 and of the production method taking place therein are described in detail in virtue by example in US20190137791 which is incorporated by reference to the present description.

The construction and function of the transportation boxes T as transportation carrier used for production will be explained with reference to FIGS. 2 and 3.

Figure 2:
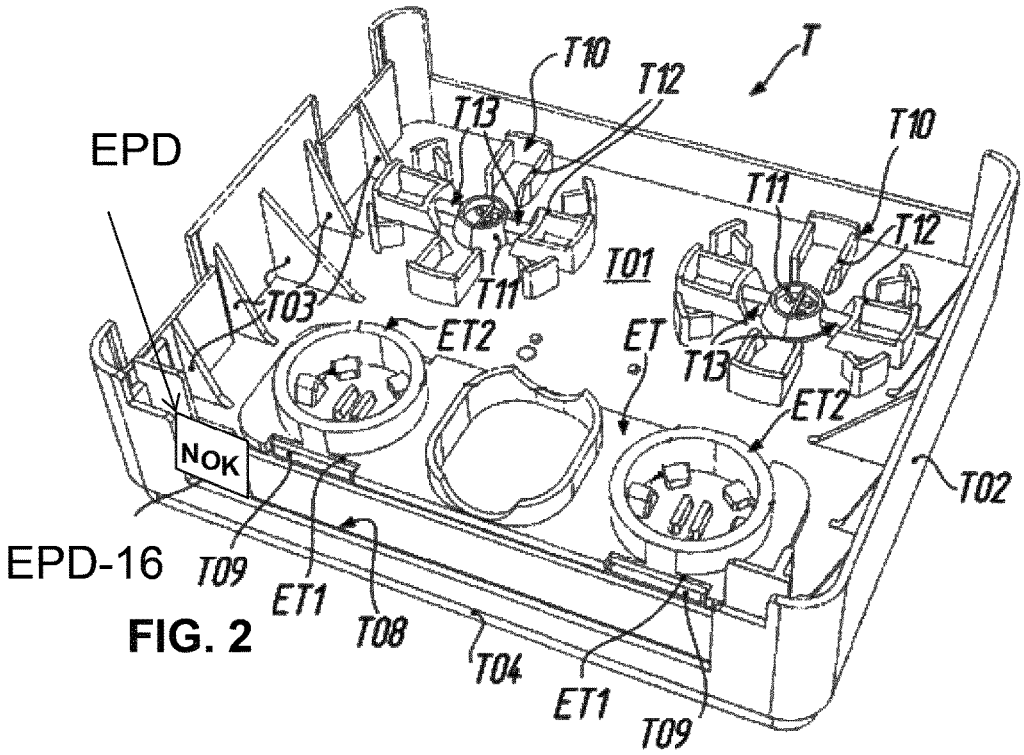
FIG. 2 shows a perspective view of an empty transportation box obliquely from above and front right, which can be used in the production layout according to FIG. 1 and equipped with an electronic paper display fixed to the transportation box.

According to, in particular, FIG. 2, the transportation boxes T, which are preferably injection-molded from a suitable plastics material, have a substantially rectangular box base T01, from the edge of which an encircling box wall T02 extends upwardly on the upper side of the transportation box T, which box wall includes with the box base T01 an approximate right angle and is stiffened on the transverse sides of the transportation box T relative to the box base T01 by a plurality of ribs T03.

An apron section T04 extends on the underside of the transportation box T in substantially encircling manner approximately at right angles away from the box base T01 and, in particular, with a slight offset inwardly from the edge of the box base T01. As a result, the transportation box T is capable of stacking, wherein the apron section T04 of a transportation box T which is upper in the stack enters into an opening which is bounded outwardly by the box wall T01 of the transportation box T disposed thereunder. Through different design of the transverse sides of the transportation box T in the region of the box wall T02 and of the apron section T04, it is thereby ensured that the transportation boxes T can be stacked only in mutual longitudinal orientation, but not turned through 180° relative to one another.

In addition, the apron section T04 is stiffened relative to the box base T01 at the longitudinal sides of the transportation box T by use of a plurality of not represented ribs.

The box wall T02 is provided on a longitudinal side, which is at the front in FIG. 2, of the transportation box T with a slot T08.

An insert part ET of plastics material constructed for mechanically positive reception of two block pieces B is retained at the box base T01 adjacent to the slot T08. The insert part ET is in that regard mechanically positively held in longitudinal and transverse direction of the transport box T by way of webs T09 projecting from the box base T01 and engaging in associated cut-outs ET1 of the insert part ET. The insert part ET has with respect to a transverse axis of the insert part ET a mirror-symmetrical arrangement of two substantially hollow-cylindrical receiving sections ET2 for the block pieces B.

A plurality of web-shaped receiving projections T10 is formed at the box base T01 on the upper side, which lies adjacent to the insert part ET for the block pieces B, of the box base T01 in similarly mirror-symmetrical arrangement with respect to a transverse axis of the transportation box T. The receiving projections T10 are respectively grouped in a circle in star-like manner about one of two central protrusions T11 of the box base T01. In that case, upper end surfaces T12 of the receiving projections T10 drop away in their height relative to the box base T01 towards the projections T11, as a result of which lens blanks LR or spectacle lenses L placed on the receiving projections T10 contact the receiving projections T10 at the end surfaces T12 by only an edge region and at the same time undergo a degree of centering.

Finally, structures complementary to chucking sections of the block pieces B, i.e. the receiving projections T10 and protrusions T11, are also formed at the box base T01 in this region of the transportation boxes T at the reference numeral T13. This makes it possible to receive and transport the lens blanks LR or spectacle lenses L in blocked state by way of the block pieces B in mechanically positively secured and positionally oriented manner in the transportation boxes T.

Figure 3:
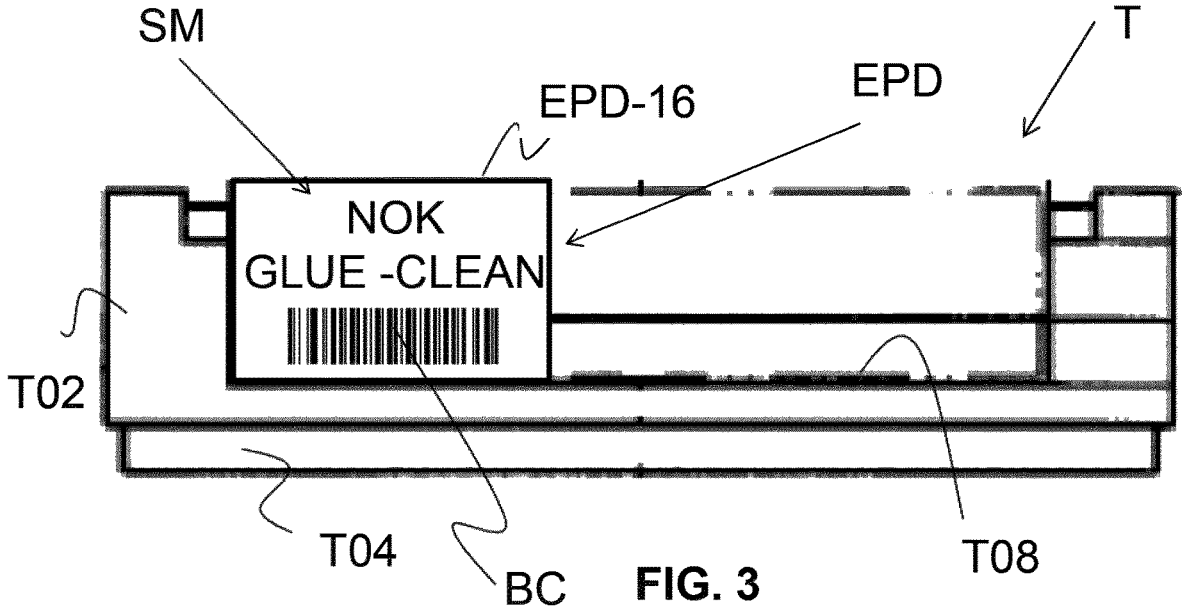
FIG. 3 shows an example of a side view of a transportation box equipped with an electronic paper display fixed to the transportation box, FIG. 4 show a simplified synoptic scheme of an electronic paper display as in FIG. 2 or 3.

As can be seen in FIGS. 2 and 3, an electronic paper display EPD is fixed to the transportation box T, in particular clipped into the slot T08. Furthermore, in order to allow for example cleaning of the transportation box T, the electronic paper display EPD may be removed from the transportation box T.

In case the transportation carrier is realized in another way, for example as block piece B or as a separate transportation carrier supporting a detachable block piece B, the electronic paper display EPD is also fixed, in particular removable, to that transportation carrier.

An electronic paper display EPD is a display device that mimics the appearance of ordinary paper and reflects light like paper. It's an electronic device allowing change of the information to be displayed.

Once information is displayed, an electronic paper display EPD can hold static texts or images for at least 6 month without outside supply of electricity. This is one of the advantages making them quite useful in the context of transportation carriers for lens manufacturing as one can easily understand thanks to the description set out hereafter.

Figure 4:
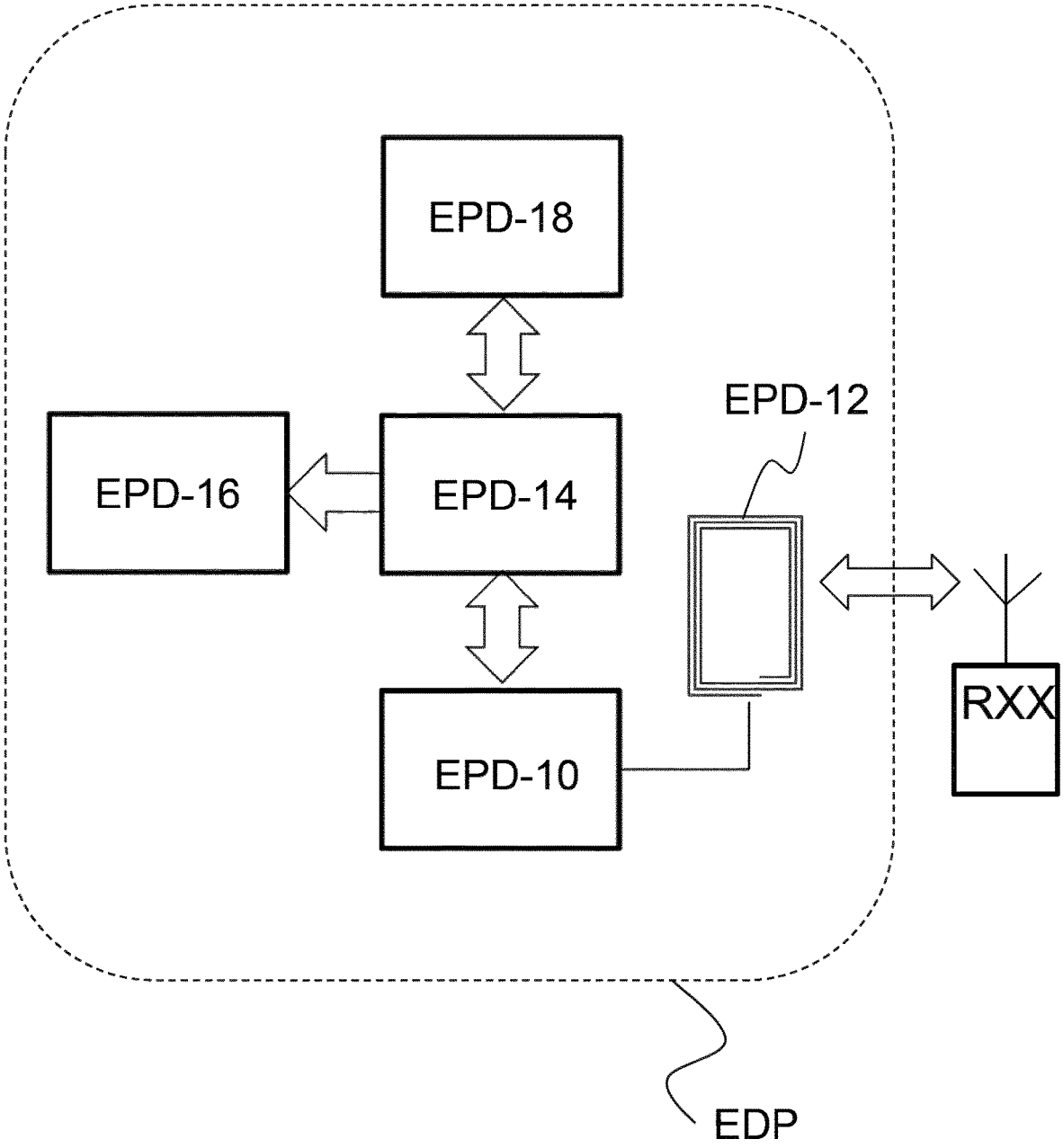

FIG. 4 shows a simplified synoptic scheme of an electronic paper display EPD.

In particular, the electronic paper display comprises a wireless communication module EPD-10 with an antenna EPD-12 for communicating with a reader/writer device RXX (in FIG. 1, as examples several reader/writer devices R01, R02 . . . R10 which are communicating with a process control system PS, are represented at different locations of the manufacturing facility 1). The wireless communication module EPD-10 with its antenna EPD-12 is for example an RFID module communicating at a frequency of 13.56 Mhz. The RFID module is in particular a passive RFID module that is powered by an electromagnetic field received by antenna EPD-12 when being in the proximity of a RFID reader/writer RXX and does not need a specific supply battery for its functioning. Thus, the electronic paper display EPD is batteryless and does not need for example a rechargeable a power source for functioning. All energy needed for functioning can be sourced by an electromagnetic field received by antenna EPD-12 when being in the proximity of a RFID reader/writer RXX. The electronic paper display EPD is therefore very autonomous and not subject to failures because of a defective or discharged battery.

This is an advantage because it is more robust and needs less maintenance, in particular in a manufacturing facility with a park of transportation carriers.

Communication can for example be carried out according to known standards as ISO 14443 and/or ISO 15693.

Electronic paper display EPD may further comprise a processing unit EPD-14 configured for example to receive or transmit data from/to the communication module EPD-10, a display unit EPD-16 controlled by the processing unit EPD- 14 and a memory EPD-18, for example a EEPROM communicating with the processing unit EPD-14 for example for memorizing specific data, in particular real time and up-to-date with regard to the lens manufacturing process and the prescription order of the lenses L to be manufactured.

The electronic paper display EPD is in particular configured to exchange information with said lens manufacturing facility, specifically the process control system PS, during lens manufacturing process.

Thus the information during lens manufacturing may be updated in the memory EPD-18 and also the information displayed on the display unit EPD-16 can be updated dynamically, in particular by reader/writer devices RXX (XX=01, 02, . . . , 10).

As shown in FIGS. 2 and 3, the electronic paper display EPD is configured to display at least one up-to-date status information which is intelligible for a human operator without use of a reading device. Intelligible for a human operator should be understood as "meaningful" as it stands with no need to use a specific reader.

The displayed information is intelligible for a trained human operator working in the manufacturing facility.

In the present example, the display shows for example a short message "NOK" (=NOT OK) in FIG. 2 which is a clear message for a human operator that an action has to be taken with regard to the content in the transportation box T. Instead of or in addition of a short message, a symbol or pictogram may be displayed (thumb down for "NOK" for example).

In the example of FIG. 3, the display not only shows the message "NOK", but also an understandable instruction for a human operator "GLUE-CLEAN", meaning that the lenses L in the transportation box T need a further, manually initiated cleaning step, because for example the lenses present some glue rests that prevent further processing.

The display also shows in addition one optical machine readable identification information like a barcode identification which is for example linked to the job identification and the prescription order and may be read during the processing in the manufacturing facility MF. In another example, the barcode identification symbol may be replaced by a QR-code.

Consequently, use of an electronic paper display EPD allows showing intelligible up-to-date information to a human operator without need of a specific reader and the operator can take a necessary action.

In the example of FIG. 4, the electronic paper display EPD is configured to share EEPROM EPD-18 with the wireless communication module EPD-10 (also referred as RFID tag). Thus, the RFID tag is integrated to the electronic paper display EPD.

However, one may also have a separate RFID-tag for job identification fixed to the transportation box T or the transportation carrier in the general sense.

Returning now to FIG. 1, it is firstly to be noted at this point that for the production method there is a fixed association between the block pieces B and the transportation boxes T, wherein associated block pieces B and transportation boxes T are always stored together and, as already mentioned, are transported on transport belts through the manufacturing facility MF. It is additionally assumed that in the manufacturing facility MF shown here, use is made of between for example 20 and 40 block piece types, which differ in geometry with respect to diameter and block curvature of the lens fastening surface, so as to process predominantly lens blanks LR of plastics materials, thus ductile materials. In that regard, each of the block pieces B has to be identified by way of an individual numerical sequence, which, for example, is applied by use of a DMC (Data Matrix Code or QR-code) to the block piece B, so that it can be detected during filling of the transportation boxes T with the block pieces B and memorized in memories of the process control system PS.

The process control system PS may comprise computers, processors and memories as well as software configured for controlling the whole manufacturing process of the optical elements L.

The process control system PS communicates with the different processing stations and controls the transfer system with its conveyors.

The process control system PS also receives job data for each spectacle lens L to be manufactured. Each transportation box T contains in general two lens blanks to be processed and is specifically identified as will be outset hereafter.

Detectors and communications devices RXX are disposed in the transportation system, in particular along conveyors and upstream and downstream of the processing stations.

These detectors and communications devices RXX allow in particular localizing and directing the transportation boxes T within the manufacturing facility T. They are also configured to feed dynamically the electronic paper display EPD and in particular the memory EPD-18 and the display unit EPD-16 with up-to-date information as will be set out hereafter by the way of description of examples.

As far as the coding of the transportation boxes T is concerned, there is initially stored on electronic paper display EDP of the respective transportation box T a numerical sequence which is composed of a first, invariable numerical group for identification of the electronic paper display EDP, and thus the respective transportation box T and for example two further or more, variable numerical groups.

In a not shown example where the transportation carrier may be equipped with an electronic paper display EDP and a separate RFID identification transponder, the latter will also be configured to memorize the same numerical sequences.

Linking with the numerical sequence of the block pieces B received in this transportation box T is carried out in the process control system PS by way of the invariable numerical group of the transportation box T. By contrast, the variable numerical groups of the transportation box T serve for example for memorizing the geometry of the respectively associated block pieces B (diameter and block curvature) in the RFID of the corresponding transportation box T by use of the process control PS as a function of the DMC detected at the respective block pieces B.

In most cases, two block pieces B of the same type are assigned to a transportation box T. However, it is obviously also possible for two block pieces B of different type to be assigned to a transportation box T (so-called "mismatch" jobs in the case of an anisometropia in the corresponding prescription order).

In addition, in a given case a further item of status information or geometry information can be stored on the RFID of the transportation box T. The afore-described linking of the individual block piece numerical sequence with the invariable numerical group of the respective transportation box T makes it possible to store in the process control system PS for each individual block piece B, through detection of the information memorized in the electronic paper display EPD of the associated transportation box T, for example the number of blocking processes for this block piece B.

It is schematically illustrated in FIG. 1 how the transportation boxes T are transported on conveyor belts through the spectacle lens production, wherein the top storage positions of each transportation box T are indicated by four squares. Depending on the respective processing advance of the lens blanks LR or spectacle lenses L transported in the transportation boxes T the following filling states are to be seen:

a) The two upper squares each contain a circle with a cross, whereas the two lower squares are empty: merely block pieces B are present in the corresponding transportation boxes T.

b) The two upper squares each contain a circle with a cross, whereas unfilled circles are illustrated in the two lower squares: block pieces B and lens blanks LR in the unblocked state are present in the corresponding transportation boxes T.

c) The two upper squares are empty, whereas filled circles are shown in the two lower squares: blocked lens blanks LR, or blocked, processed spectacle lenses L are present in the corresponding transportation boxes T.

d) Special case: There can be seen, inter alia, an unfilled and a filled circle in the squares: in the case of the prescription order in this transportation box T there was a problem with deblocking and/or an impermissible contamination of at least one deblocked, processed spectacle lens L.

e) Subcase (not illustrated): Block pieces B and deblocked, treated spectacle lenses L also processed at the edge RD are present in the corresponding transportation box T.

In addition, the individual working or processing stations are marked by symbols, wherein workstations AS 1 to AS 9, at which merely steps for preliminary processing or adjusting of the lens blanks or spectacle lenses L are carried out, whereas processing stations BS 1 to BS 6, in which the lens blanks LR or spectacle lenses L undergo a change through processing or treatment (value-enhancing measures at the lenses).

The central process control system PS is symbolically marked in FIG. 1 by a lozenge.

Detection and communication devices are referenced RXX or with solid triangles are indicated along the conveyor paths or conveyor belts of the production line of FIG. 1., in the block piece store BL and in the finishing region FSB, which devices automatically detect the transportation boxes T when passing and pass on the data stored in the electronic paper display EPD (reading and transmitting function) to the process control system PS.

If, for example, a detected transportation box T is to be processed in a processing station following a detecting device this transportation box T is released by the process control system PS for processing and transferred over to the corresponding processing station.

Apart from these detection and communication devices having a reading and transmitting function, still further detecting devices marked with lozenges are for example provided in the working or processing stations and stores for block pieces B, lens blanks LR and spectacle frames (not shown), these devices communicating with the process control system PS and conversely (reading function, transmitting function and receiving function). If, for example, a transportation box T is detected in a processing station by the process control system PS by way of a detecting device of that kind then the process control PS transmits the processing data, which is filed for a respective prescription order, to this processing station.

If this lozenge is in addition illustrated in solid form, then the corresponding detecting device additionally has a writing function for changing or expanding the information in electronic paper display EPD of the transportation box T instantaneously present. The latter detecting devices additionally pass on production-relevant data to the process control PS.

According to one example, in the production manufacturing facility MF to FIG. 1, the production of individual spectacle lenses L in accordance with prescription order now may take place as follows:

Prior to the actual production, transportation boxes T constructed expressly as described above are manually furnished in a preliminary processing station VS with block pieces B, wherein linking of the block pieces B with the respective transportation box T takes place by way of the process control system PS as explained above. The transportation box T furnished with the block pieces B is then deposited on a conveyor belt in the direction of the block piece store BL. The block piece store BL generally comprises a store entrance LE and a store exit LA, which are connected together by way of a conveyor path for the transportation boxes T.

After travelling beyond the store entrance LE the geometry data of the block pieces carried by the respective transportation box T are detected, as described, in the block piece store BL by a detecting device which, is provided behind the store entrance LE and the respective transportation box T is assigned either to a sorted buffer store or a flexible box store depending on the respective block piece type which is loaded. A maximum number of store places is reserved by the process control system PS in these stores individually for each block piece type. If all appropriate store places should be occupied, the transportation box T is intermediately stored in the unsorted buffer store.

At passage of the store exit LA, the transportation box T is checked if the necessary block pieces B are disposed in the transportation box T.

If the necessary block pieces B are not in transportation box T (for example they are missing or the disposed block pieces are not those suited for the job to be done or the DMC is not readable, the transportation box T shall not be equipped with lens blanks LR.

In this case the corresponding transportation box T is barred by the process control system PS from onward transport and at the downstream switch is removed into a manual work station MS for manual action to be taken by a human operator. In addition, just downstream store exit LA, a detection and communication device R02 transmits up-to-date status information to the electronic paper display EPD.

In this case, display unit EPD-16 shows for example the message as can be seen in FIG. 2 "NOK". Even more precise information like "BP MISS" for "block piece BL missing" or instructions for handling the outsorted transportation box T can be displayed by display unit EPD-16.

Thanks to the displayed intelligible up-to-date information, a human operator therefore can recognize very fast what to do and how to solve the problem he is faced to.

On presentation of a prescription order, with knowledge of the geometry of the spectacle lenses to be produced a transportation box T with block pieces B appropriate thereto is usually demanded by the process control system PS from the block piece store BL and transported by way of the transport belt to a semi-finished product store HL.

The transportation box T is here detected again by the process control system PS and subsequently thereto manually or automatically loaded with usually round or oval, still unedged, lens blanks LR which have already been processed to finished state at a first surface thereof, preferably even finish-coated (hard coating and anti-reflection coating).

The electronic paper display EPD may receive data indicating urgency of the respective prescription order and this may be displayed by the display unit EPD-16 by a short message or a symbol.

Thus, without need of a reader unit, a human operator may be informed that this transportation box T shall benefit from specific handling.

For the subsequent step (i) of blocking, the provision of the respective block piece B is thus habitually carried out by way of the process control system PS as a function of the geometry, which is defined by the prescription order, of the spectacle lens L, which is to be produced, by issue from the block piece store BL of the transportation box T loaded with the corresponding block piece B identified by the electronic paper display EPD.

Next, the transportation box T is transported to a blocking station AS 1. Blocking of the lens blanks LR on the block pieces B brought along in the same transportation box T is carried out here. For blocking, use is preferably made of devices such as described in detail in document U.S. Pat. No. 8,616,150, which is hereby incorporated by reference with respect to construction and function of these devices. In summary, in the case of the blocking method used the lens blank LR is positioned so as to leave a gap (also known as "spatial blocking") relative to the block piece B, which is then filled out by a blocking material, which cures under ultraviolet light, before the blocking material is hardened by irradiation with ultraviolet light and thus the lens blank LR fixed to the block piece B. The thereby-resulting individual block height is reported to the process control system PS and to the electronic paper display EPD where it can be similarly stored thereon and displayed by the display unit EPD-16.

This individual block height is also known as "setting value". For the following processing stations BS, this value is important in order to preserve the necessary predetermined material thickness of the finished lenses L.

This setting value is normally in a certain range and for a human operator supervising the manufacturing facility 1, display of this dynamic information on the display unit EPD-16 allows a rapid visual control that blocking station AS 1 is working well and does not need a human intervention.

The display of the numerical value can be replaced by a specific symbol showing that the setting value is within the allowed range or not.

Such rapid visual control is in particular important in case of a fault in the system and the human operator needs to understand the reason of the fault.

One has also to take into account that the production rate of such manufacturing facility is quite high and any interruption has an important impact on profitability. Therefore any faults need to be understood as fast as possible in order to allow to take the necessary measures.

Such visual control also helps to speed up a human operator in fault analysis.

The lens blanks LR blocked on the block pieces B are subsequently re-inserted into the respective transportation box T at the lens positions, after which the transportation box T is transported onward to a preliminary processing station BS 1.

In the preliminary processing station BS 1 the blocked lens blanks LOB are firstly removed from the transportation box T and processed at a second surface, also termed "generating" in the line of work.

In that regard, the macrogeometry to be created in accordance with the prescription order at the second surface of the respective blocked lens blank LOB is produced by machining with tools with a specific edge. Use is made of, in particular, so-called "generators" which for the processing of plastics material can provide combined milling and turning and for that purpose have not only a milling spindle, but also a fast-tool servo for drive of a turning chisel, such as described in, for example, document U.S. Pat. No. 7,975,356 which is hereby incorporated by reference. For the milling work, initially so-called "cribbing" can be carried out in order to rapidly remove material, wherein the circumference of the lens blanks LR is reduced to an extent necessary for formation of the optically effective surface. In that regard, it can happen that in company with the lens blank LR the block piece is decentered so that it receives a different diameter at the lens fastening surface BF. This can be reported by the preliminary processing station BS 1 to the process control system PS and the electronic paper display EPD which is updated accordingly, whereupon the corresponding block pieces B are reclassified for the next cycle in the production line. Thus the electronic paper display EPD may also display on its display unit EPD-16 this up-to-date status information.

Subsequently, the blocked lens blanks LOB are reloaded into the respective transportation box T and transported by way of the transport belt onward in the direction of a precision processing station BS 2. Precision processing of the optically effective surfaces is carried out here by a precision grinding machine or a polishing machine so as to remove preliminary processing tracks and achieve the desired microgeometry. Such a polishing machine is described in for example, document U.S. Pat. No. 8,628,071 or document U.S. Publication No. 2017/0246720 which are hereby incorporated by reference.

The transportation box T carrying the blocked lens blanks LOB goes onward to a marking station BS 3 in which the blocked lens blanks LOB are, for example, engraved by use of a laser. Apart from assist points for later orientation for edge processing, markings for the installation side, logos, manufacturer designations, addition effect of the spectacle lens and the order number can be engraved here.

The blocked lens blanks LOB are then transported onward by the transportation box T to a coating station BS 4. A hard coating is applied there for protection of the finished optically effective surfaces of the blocked lens blanks LOB. For that purpose the blocked lens blanks LOB are firstly automatically cleaned and dried, after which they are coated by use of dip coating plant or centrifugal coating plant as described in, for example document U.S. Pat. No. 7,748,341 B1 which is hereby incorporated by reference so as to obtain processed, blocked spectacle lenses L.

The following (optional) vacuum coating station BS 5, which the blocked spectacle lenses LOB reach in their transportation box T, offers the possibility of applying further coatings such as anti-reflection or anti-adhesion coatings under vacuum conditions, for which purpose the blocked spectacle lenses LOB are moved into the vacuum coating station BS 5 initially for drying and degasification without the transportation box T through tunnel ovens.

After the coating process the blocked spectacle lenses LOB are brought by use of their transportation box T to a deblocking station AS 2, where the spectacle lenses L are automatically separated from the block pieces B, as already described in the introduction. A device of that kind for particularly rapid and certain deblocking of optical workpieces is known from, for example, document U.S. Pat. No.

8,931,769 which is hereby incorporated by reference. Thereafter, both the spectacle lenses L and the block pieces B of the respective prescription order are placed back in the associated transportation box T.

From the deblocking station AS 2 the respective transportation box T is transported on the conveyor belt through a station AS 3 for recognition of blocking material residue. If no blocking material residues can be detected by the station AS 3 for blocking material residue recognition on the deblocked spectacle lenses L present in the transportation box T the respective transportation box T is released by way of the process control system PS for onward transport and can pass a switch downstream of the station AS 3 for recognition of blocking material residue.

If the spectacle lenses L in the deblocking station AS 2 could not be successfully deblocked or if blocking material residues are still present on the spectacle lenses L then the corresponding transportation box T is barred by the process control system PS from onward transport and at the downstream switch is removed into a station AS 4 for manual deblocking and cleaning. In addition, just downstream station AS 3, a detection and communication device transmits up-to-date status information to the electronic paper display EPD of the relevant transportation box T.

In this case, display unit EPD-16 shows for example the message as shown in FIG. 3 "NOK" and "GLUE-CLEAN". If another fault has been detected, other short messages might be displayed.

Thanks to the displayed intelligible up-to-date information, a human operator therefore can recognize very fast what to do and how solve the problem.

After successful subsequent processing by a human operator (manual deblocking or cleaning of the spectacle lenses L) the transportation box T is returned on the transport belt to back in front of the station AS 3 for recognition of blocking material residue and passes this again in order to gain release. If contamination on or at the block pieces B is ascertained at the station AS 3 for recognition of blocking material residue this is reported to the process control system PS and this transportation box T with its block pieces B is barred from the next cycle.

In this case, display unit EPD-16 shows for example the message as "NOK" and "CANCEL JOB". The human operator thus knows that this specific job has to be restarted from scratch and that the concerned transportation box T with the defect lenses shall be sorted completely out.

One therefore understands the advantage of the electronic paper display EPD with its updates status information, because station AS 3 may sort out transportation boxes for several different reasons, or several times for the same reason.

For a human operator, it would be quit cumbersome to read with a specific barcode reader for example for every outsorted transportation box T the detected defect and what to do. He can therefore accelerate his action and focus on the remedy actions to be taken.

The released spectacle lenses L and block pieces B then pass in their transportation box T to a cleaning station AS 5. An automated cleaning of the spectacle lenses L in a brush washing system as well as optionally manual cleaning of the block pieces B is carried out here.

Thereafter, the spectacle lenses L and block pieces B together with the associated transportation box T pass to a checking station AS 6 in which a properties check of the spectacle lenses L with respect to the properties thereof in accordance with prescription is carried out and the spectacle lenses L are additionally checked for mechanical damage such as scratches and other cosmetic problems.

For these checks, display unit EPD-16 may show for example an intelligible short message as "NOK", "OK", "SCRATCH" or else.

Not only the human operator easily knows about the status of the treated jobs, but this also might help him to speed up failure analysis.

Subsequently, thereto the transportation boxes T together with their block pieces B and spectacle lenses L of the respective prescription order travel to a finishing region FSB. The transportation boxes T with the spectacle lenses L not to be edged are there identified by the process control system PS and removed to a station for final checking and packing. The spectacle lenses L are there removed from the respective transportation box T, checked, packed and passed on without the transportation box T to a common dispatch point for all spectacle lenses L or spectacles. The transportation box T, which is now still furnished merely with the associated block pieces B, is in the meantime transported onward in the direction of the block piece store BL.

By contrast, the transportation boxes T with the spectacle lenses L to be edged pass together with the associated block pieces B to an edge processing station (not shown) with at least one device for edge processing of spectacle lenses—also termed "edger" in the line of work—such as is available from, for example, the Applicant under the trade designation "ES-5". In this device the spectacle lenses L are removed from the transportation boxes T and the edges of the spectacle lenses L are so processed in accordance with the processing specifications filed in the process control PS that the spectacle lenses L can be inserted into a preselected spectacle frame BG. The spectacle lenses L with finished edges are subsequently placed back in the transportation box T with respect to the block pieces B present therein.

Finally, with respect to further details relating to individual steps of an ART lens production line reference is additionally made at this point expressly to the Applicant's brochure discussed in the introduction.

One therefore understands that the electronic paper display EPD even in a quite fully automated manufacturing facility allows easing intervention of human operators/supervisors and helps in problem analysis and decision making processes for taking faster the necessary remedies.

REFERENCE NUMERAL LIST

AS X—workstations, X=1, 2 . . . 9
B—block piece
BC—bar code
BL—block piece store
BS X—processing stations, X=1, 2 . . . 6
EPD—electronic paper display
EPD-10—wireless communication module
EPD-12—antenna
EPD-14—processing unit
EPD-16—display unit
EPD-18—memory, for example EEPROM
ET—insert part
ET1—cut out
ET2—hollow cylindrical receiving section
FSB—finishing region
HL—semi-finished product store
L—optical element/spectacle lens
LA—store exit
LE—store entrance
LOB—blocked lens blank LR—lens blank
MF—manufacturing facility
MS—manual work station
PS—process control system
RXX—reader/writer devices, XX=01, 02 . . . , 10
SM—short message
T—transportation box as example of a transportation carrier
T01—box base
T02—box wall
T03—ribs
T04—apron section
T08—slot
T09—webs
T10—webshaped receiving section
T11—protrusion
T12—end surface
T13—region of transportation box T
VS—preliminary processing station

The invention claimed is:

1. A transportation carrier for an automated lens manufacturing process in a lens manufacturing facility, comprising:

at least one block piece or one block piece receiving section; and an electronic paper display configured to display at least real-time and up-to-date status information of the manufacturing process of optical elements carried by the transportation carrier allowing a human operator to get direct intelligible instructions, which include text, of an action to take without use of a reading device even when a shutdown of the lens manufacturing facility occurs, the electronic paper display comprising a wireless communication module and a memory configured to exchange and to memorize job information and to process information for lenses to be manufactured, wherein the electronic paper display is further configured to function as a passive RFID tag with the wireless communication module.

2. The transportation carrier according to claim 1, wherein the electronic paper display is battery-less.

3. The transportation carrier according to claim 1, further comprising a separate RFID tag, wherein the electronic paper display and the separate RFID tag are configured to share a memory.

4. The transportation carrier according to claim 1, wherein the up-to-date status information comprises a message.

5. The transportation carrier according to claim 1, wherein the electronic paper display is further configured to display at least one optical machine-readable identification information.

6. The transportation carrier according to claim 5, wherein the at least one optical machine-readable identification information is a barcode or a QR-code.

7. The transportation carrier according to claim 1, wherein the electronic paper display is further configured to receive and to display processing data for lenses to be manufactured.

8. The transportation carrier according to claim 1, wherein the electronic paper display is removably fixed to the transportation carrier.

9. The transportation carrier according to claim 8, wherein the electronic paper display is removably fixed by clipping elements.

10. The transportation carrier according to claim 1, wherein the transportation carrier is a transportation box according to DIN 58763, and wherein the electronic paper display is fixed to a side wall of the transportation box at a location configured to receive a paper barcode.

11. A manufacturing facility for a manufacturing process of optical elements, comprising:

several workstations and processing stations;

a transfer system configured to convey transportation carriers for optical elements to be processed according to specific job data;

transportation carriers each comprising at least one block piece or one block piece receiving section and an electronic paper display configured to display at least real-time and up-to-date status information of the manufacturing process of the optical elements carried by the transportation carrier that is intelligible for a human operator without use of a reading device, the electronic paper display comprising a wireless communication module and a memory configured to exchange and to memorize job information and to process information for lenses to be manufactured, wherein the electronic paper display is further configured to function as a passive RFID tag with the wireless communication module; and a process control system configured to communicate with the workstations and the processing stations and to control the transfer system for conveyance of transportation carriers for optical elements to be processed according to specific job data, wherein the process control system is further configured to communicate with the electronic paper displays of the transportation carriers for displaying the at least real-time and up-to-date status information of the manufacturing process of the optical elements carried by the transportation carriers allowing a human operator to get direct intelligible instructions, which include text, of an action to take without use of the reading device even when a shutdown of the manufacturing facility occurs.

* * * * *